United States Patent [19]

Flemming et al.

[11] Patent Number: 4,946,100

[45] Date of Patent: Aug. 7, 1990

[54] LIQUID DISPENSER

[76] Inventors: J. Peter Flemming, R.D. #2, 6 Cleveland Rd. West, Princeton, N.J. 08540; Robert J. Dee, 338 S. 3rd Street, Philadelphia, Pa. 19106

[21] Appl. No.: 365,600

[22] Filed: Jun. 13, 1989

Related U.S. Application Data

[63] Continuation-in-part of Ser. No. 156,729, Feb. 17, 1988, Pat. No. 4,878,601, which is a continuation-in-part of Ser. No. 156,439, Feb. 16, 1988, abandoned.

[51] Int. Cl.[5] ..... B05B 9/03; B01F 11/00

[52] U.S. Cl. ..... 239/1; 239/106; 239/124; 239/144; 239/583; 366/332

[58] Field of Search ..... 239/1, 106, 124, 142, 239/144, 583; 366/332, 333; 251/129.1

[56] References Cited

U.S. PATENT DOCUMENTS

| | | | |
|---|---|---|---|
| 904,371 | 11/1908 | Stewart | 239/142 X |
| 2,281,094 | 4/1942 | Chambers | 366/332 X |
| 2,619,116 | 11/1952 | Ralston | 251/129.1 X |
| 3,042,310 | 7/1962 | Franke et al. | 239/144 X |
| 3,589,610 | 6/1971 | Wahlin | 239/583 X |

*Primary Examiner*—Andres Kashnikow
*Assistant Examiner*—William Grant
*Attorney, Agent, or Firm*—Joel F. Spivak

[57] ABSTRACT

A liquid dispensing system for selectively dispensing a plurality of different liquids includes a separate reservoir for each of the fluids, and a separate nozzle for dispensing each of the fluids. A separate hydraulic dispensing system having a cylinder containing a piston is connected to each reservoir and nozzle for removing fluid from each reservoir and feed the liquid to the respective nozzle. A single hydraulic operation system including a cylinder containing a piston is connected to each dispensing cylinder to selectevely operate the piston in each dispensing cylinder. The piston in the operating cylinder is operated by an electric motor having a threaded shaft, a nut on the threaded shaft and a drive arm of the nut. The drive arm is connected to the piston in the operating cylinder to move the piston a selected distance and thereby dispense a selected amount of liquid from a selected nozzle. Alternatively, the drive arm on the nut can be connected directly to the piston in the dispensing system.

18 Claims, 7 Drawing Sheets

FIG. 6
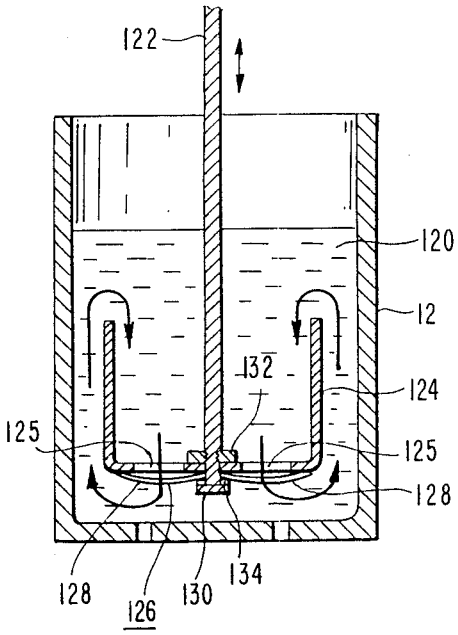
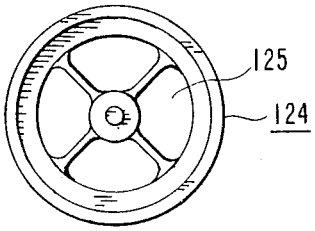
FIG. 7

LIQUID DISPENSER

This is a continuation-in-part of my co-pending application Ser. No. 156,729, filed Feb. 17, 1988 entitled LIQUID DISPENSER issued on Nov. 7, 1989 as U.S. Pat. No. 4,878,601, which application is a continuation-in-part of application Ser. No. 156,439 filed Feb. 16, 1988, now abandoned.

FIELD OF INVENTION

The present invention relates to a liquid dispenser system for such liquids as paint pigments, toners, etc., and more particularly to a liquid dispenser system having an improved nozzle and/or liquid mixer.

BACKGROUND OF THE INVENTION

There are a number of applications for liquid dispensers which dispense a controlled amount of liquid which contains particles suspended therein. In paint stores, paint pigments are mixed accurately to a formula to create various color tones. These color tones must be able to be accurately reproduced. Therefore, it is necessary to have a dispenser which can dispense controlled amounts of different color pigments easily and quickly. Existing paint pigment dispensers are of two general classes. The first class is a multichannel gear pump. In this device a gear exerts a constant pressure to a pump piston and a valve is opened for a known time. Since pressure is controlled by the gear and the time the valve is open is known, an approximately known amount of pigment is dispensed. The second class of existing systems is a multi-channel device in which a plurality of pistons and valves are provided which are actuated by motors. Since each piston displaces a known volume, a known amount of pigment is dispensed. While this class of system is more precise, it is inordinately expensive to manufacture.

Both of these systems seem to have disadvantages as far as accuracy is concerned. Both are predominately mechanical so as to be both expensive and unreliable. Also, neither are easily amenable to computer control. Therefore, it would be desirable to have a liquid dispenser which can accurately dispense a plurality of different liquids, which is relatively inexpensive, and which is amenable to computer control.

Further, no matter what system one employs, in order to maintain reproducible accuracy, the system should provide mixing means which effectively prevent the settling of particulate matter in the liquid and nozzle means which may be purged and effectively minimizes or eliminates bubbles and dead space, i.e., that is space in which the particlate matter may accumulate and from which it is not readily purged.

SUMMARY OF THE INVENTION

The present invention is directed to a system for dispensing liquids, particularly liquids having particulate matter suspended therein, such as paint pigments, which is generally more accurate and reproducible than prior art systems and preferably which is substantially less expensive to manufacture and more reliable.

This is achieved by a liquid dispenser which includes a reservoir for containing the liquid to be dispensed, means for stirring the liquid in the reservoir, and a nozzle connected to the reservoir for dispensing the liquid which nozzle has an insignificantly small dead space and is provided with means for purging said nozzle. In a preferred embodiment, hydraulic dispensing means is connected to the reservoir and the nozzle for removing some of the liquid from the reservoir and delivering the liquid to the nozzle. Operating means is connecting to the hydraulic dispensing means for operating the hydraulic dispensing means. Control means is connected to the operating means to deliver a controlled amount of liquid to the nozzle. The dispenser system may include a plurality of reservoirs each with its own nozzle and hydraulic dispensing means. In such an embodiment, the operating means is connected to all of the hydraulic dispensing means and suitable valves are provided so as to be able to selectively dispense liquid by any one of the hydraulic operating means.

BRIEF DESCRIPTION OF THE DRAWINGS

FIG. 6 is a schematic cross-sectional showing of a novel stirring means useful in a liquid dispenser system; and FIG. 7 is a top view of the cup portion of the stirring means shown in FIG. 6.

DETAILED DESCRIPTION OF THE INVENTION

We have found that in order to insure the accuracy and reproducibility required in a dispensing system for liquids having particulate matter dispersed therein, e.g. paint pigment dispensers, four primary parameters should be addressed. These parameters are: (1) precise mechanical motions of pumping parts, prefereably aided by software control to eliminate backlash effects in seals and mechanics; (2) continuous stirring of the liquid to avoid settling of solids; (3) elimination of air bubbles and places where air and solids may accumulate; and (4) appropriate dispensing sequences and hardware to minimize errors caused by drops of liquid sticking to the dispense nozzle and other parts of the system.

Prior art commercial paint dispensing machines and equipment which are relatively expensive to build and difficult to maintain are not sufficiently accurate for many present day requirements. These accuracy limitations arise, at least in part, because none of these prior art devices address all four of the above mentioned parameters.

Figure 1:
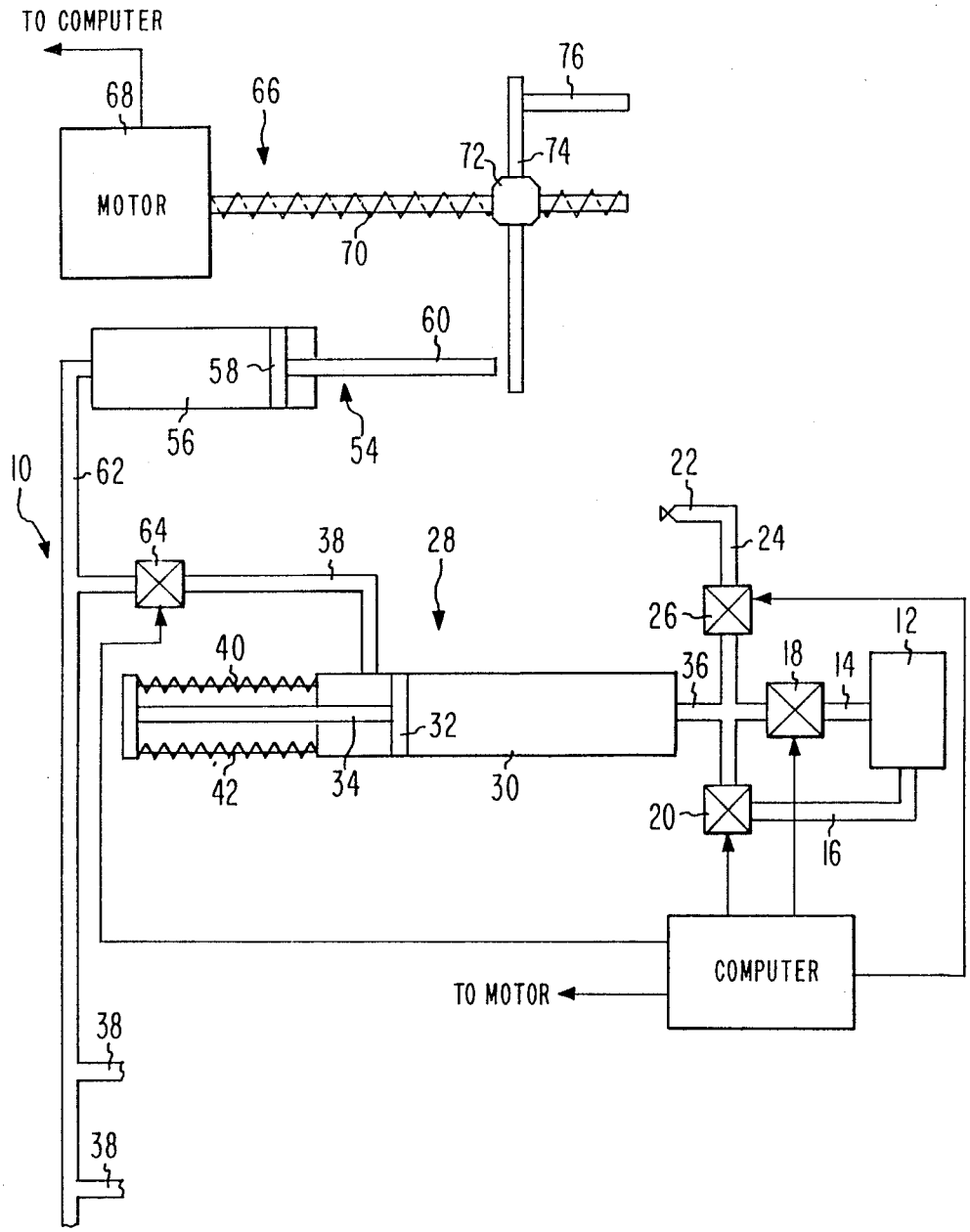
FIG. 1 is a schematic showing of a liquid dispenser system of the present invention.

Referring initially to FIG. 1, the liquid dispenser system of the present invention is generally designated as 10. Liquid dispenser 10 includes a reservoir 12 which contains the liquid to be dispensed. The reservoir 12 has an outlet pipe 14 and a return pipe 16. Electrically operated valves 18 and 20 are provided in the outlet pipe 14 and return pipe 16 respectively. A liquid dispensing nozzle 22 is connected to the reservoir outlet pipe 14 by a pipe 24 having an electrically operated valve 26 therein.

A hydraulic dispensing system 28 is connected to the reservoir 12 and nozzle 22. The hydraulic dispensing system 28 includes a cylinder 30 having a piston 32 therein and a piston rod 34 connected to the piston 32 and extending from one end of the cylinder 30. A liquid inlet/outlet pipe 36 extends from the other end of the cylinder 30 and is connected to the reservoir inlet and return pipes 14 and 16 and the nozzle pipe 24. A hydraulic fluid inlet/outlet pipe 38 extends from the cylinder adjacent the end from which the piston rod 34 extends.

Figure 2:
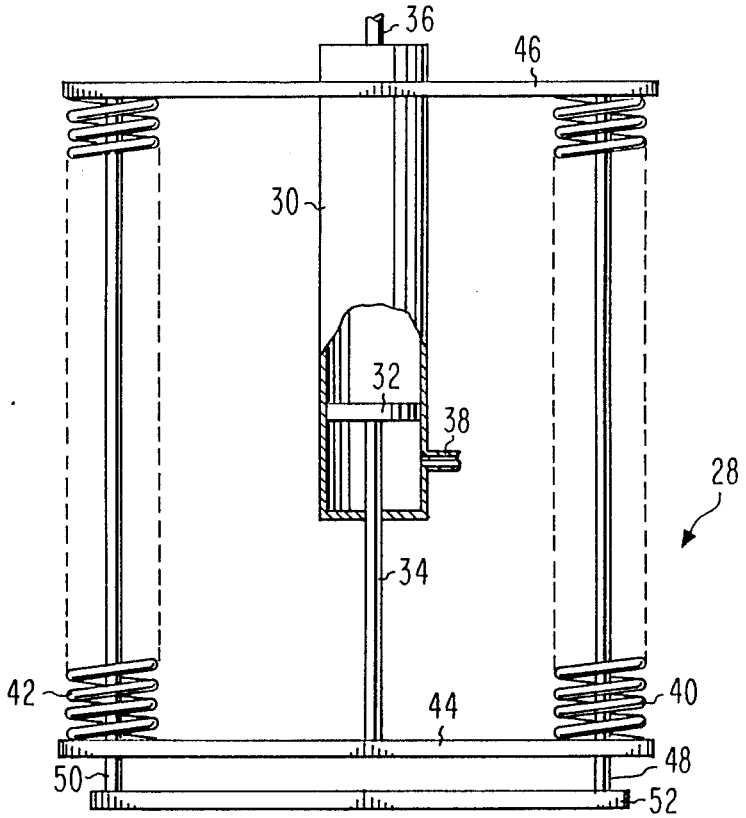
FIG. 2 is a schematic showing of the hydraulic dispenser system of the liquid dispenser of the present invention.

As shown in detail in FIG. 2, the piston 32 is spring loaded by a pair of springs 40 and 42. A plate 44 is connected to the end of the piston rod 34 and extends perpendicularly thereto. The springs 40 and 42 are compressed between opposite ends of the plate 44 and a fixed plate 46 which extends perpendicularly with respect to the cylinder 30 adjacent the other end of the cylinder 30. Thus, the springs 40 and 42 tend to push the piston 32 away from the liquid inlet/outlet pipe 36. Separate rods 48 and 50 extend through the springs 40 and 42 respectively. The rods 48, 50 are secured at one end to the fixed plate 46. The rods 48 and 50 project beyond the movable plate 44 and are secured to a stop plate 52 which extends across the side of the movable plate 44 away from the cylinder 30.

A hydraulic operating system 54 is connected to the hydraulic dispensing system 28. The operating system includes a cylinder 56 having a piston 58 therein and a piston rod 60 connected to the piston 58 and extending from one end of the cylinder 56. The cylinder 56 has a hydraulic fluid inlet/outlet pipe 62 extending from its other end. The inlet/outlet pipe 62 is connected to the hydraulic fluid inlet/outlet pipe 38 of the dispensing system cylinder 30 through an electrically controlled valve 64.

A control system 66 drives the hydraulic operating system 54. The control system 66 includes a motor 68 having a threaded drive shaft 70. A nut 72 is threaded on the drive shaft 70 and a drive arm 74 is mounted on the nut 72. The drive arm 74 is mounted on the nut 72. The drive arm 74 extends across the end of the piston rod 60. A stop member 76 is on the side of the drive arm 74 opposite the piston rod 60. Thus, rotation of the drive shaft 70 in one direction will move the drive arm 74 against the piston rod 60 and move the piston 58 into the cylinder 56 toward the inlet-outlet pipe 62. Rotation of the drive shaft 70 in the opposite direction moves the drive arm 74 away from the piston rod 60 and allows the piston 58 to move away from the inlet/outlet pipe 62 under the action of springs in the operating system. The stop member 76 limits the movement of the drive arm 74 away from the piston rod 60.

In a dispenser 10 for dispensing a plurality of different liquids, the inlet/outlet pipe 62 of the operating system cylinder 56 is connected to the inlet/outlet pipes 38 of a plurality of different hydraulic dispensing systems, not shown. Each of the hydraulic dispensing systems, like the hydraulic dispensing system 28, includes a cylinder connected to a reservoir and a nozzle.

In the operating of the dispenser 10, there are four basic operations: home, dispense, recharge, and purge. The home sequence is needed to establish a known position for the motor 68 when the dispenser is started. The motor 68 is homed by moving it until the drive arm 74 pushes against the stop member 76. During this operation all of the valves 64 between the dispensing system cylinders 28 and the operating system cylinder 56, and the valves 18 between the reservoirs 12 and their respective dispensing system cylinders 28 are opened. This allows each dispensing system cylinder 28 to be fully retracted by its springs 40 and 42 until the spring plate 44 rests against the stop plate 52. The hydraulic coupling between the dispensing system cylinders 28 and the operating system cylinder 56 causes the piston 58 of the operating system cylinder 56 to be retracted. The position of the piston 58 when the system is homed depends on the amount of hydraulic fluid in the system and it will not in general bring the piston rod 60 into contact with the drive arm 74. The hydraulic fluid is not pressurized in the home position so that the system will not leak. FIG. 1 shows the dispenser 10 in the home position.

The dispense sequence starts with the motor 68 homed. For this sequence the valve 64 between the operating system cylinder 56 and the dispensing system cylinder 30 for the particular fluid to be dispensed is opened. The valve 18 is opened to connect the reservoir 12 to the dispense system cylinder 30. The motor 68 is operated to move the drive arm 74 against the piston rod 60 and move the piston 58 a short distance, no more than about one inch. This will cause the piston 32 of the dispense cylinder 30 to move and pump some volume of the liquid in the dispense cylinder 30 back into the reservoir 12. The hydraulic system will then be pressurized by the spring mechanism and any backlash will be preloaded. Also, the seals in the pistons will be pressed into position for forward motion of the pistons, this is the predispense motion.

The valve 18 between the dispense cylinder 30 and the reservoir 12 is then closed and the valve 26 between the dispense cylinder 30 and the nozzle 22 is opened to connect the nozzle 22 to the dispense cylinder 30. The motor 68 is then operated to move the piston 58 in the operating cylinder 56 a predetermined distance. This, in turn, causes the piston 32 in the dispense cylinder 30 to move a corresponding distance and thereby dispense a corresponding amount of liquid from the nozzle 22. The amount of movement of the motor 68 to achieve the dispensing of a desired amount of liquid is determined by precalibrating the system. The motor 68 is then operated through a sequence to move the piston 32 in the dispense cylinder 30 back slightly, then forward slightly, and then back a very short distance. This results in any liquid in the nozzle 22 be sucked back into the nozzle 22 including any drops of liquid on the edge of the nozzle 22 after the dispensing is completed. The valve 26 between the nozzle 22 and the dispense cylinder 30 is then closed.

The recharge sequence always follows a dispense sequence. For this sequence, the valve 18 between the reservoir 12 and the dispense cylinder 30 is opened to allow liquid to be drawn from the reservoir 12 into the dispense cylinder 30. The motor 68 is operated to return it to its original home position and allow the springs 40 and 42 of the dispense system 28 to return the piston 32 in the dispense cylinder 30 to its original position. This pulls the liquid from the reservoir 12 into the dispense cylinder 30 and then recharges the dispense cylinder 30. The valves 64 and 18 are then closed.

The purge sequence is needed to prevent clogging of the various pipes, and, when dispensing paint pigments, to prevent the pigments from settling. This sequence begins with the system in the home position. The valve 64 between the operating cylinder 56 and the dispense cylinder 30 to be purged is opened and the valve 20 in the return pipe 16 of the associated reservoir 12 is opened. The motor 68 is then operated to move the piston 32 of the dispense cylinder 30 through its maximum stroke and thereby pump liquid back to the top of the reservoir 12. This circulates the liquid through all parts of the dispense system 28 except the nozzle 22 and its pipe 24. The nozzle 22 and its pipe 24 can be cleared, if necessary, by a small sacrificial dispense operation. After the purge sequence, a recharge sequence is performed to refill the dispense cylinder 30.

Since all of the operating mechanisms of the dispenser 20, the motor 68 and valves 18, 20 and 64, are all operated by means of a computer 69. The computer 69 can be programmed to control the sequence of operation of the motor and valves, which valve 64 is opened to dispense a particular fluid, and the operation of the motor to achieve a desired quantity of the fluid dispensed.

Figure 3:
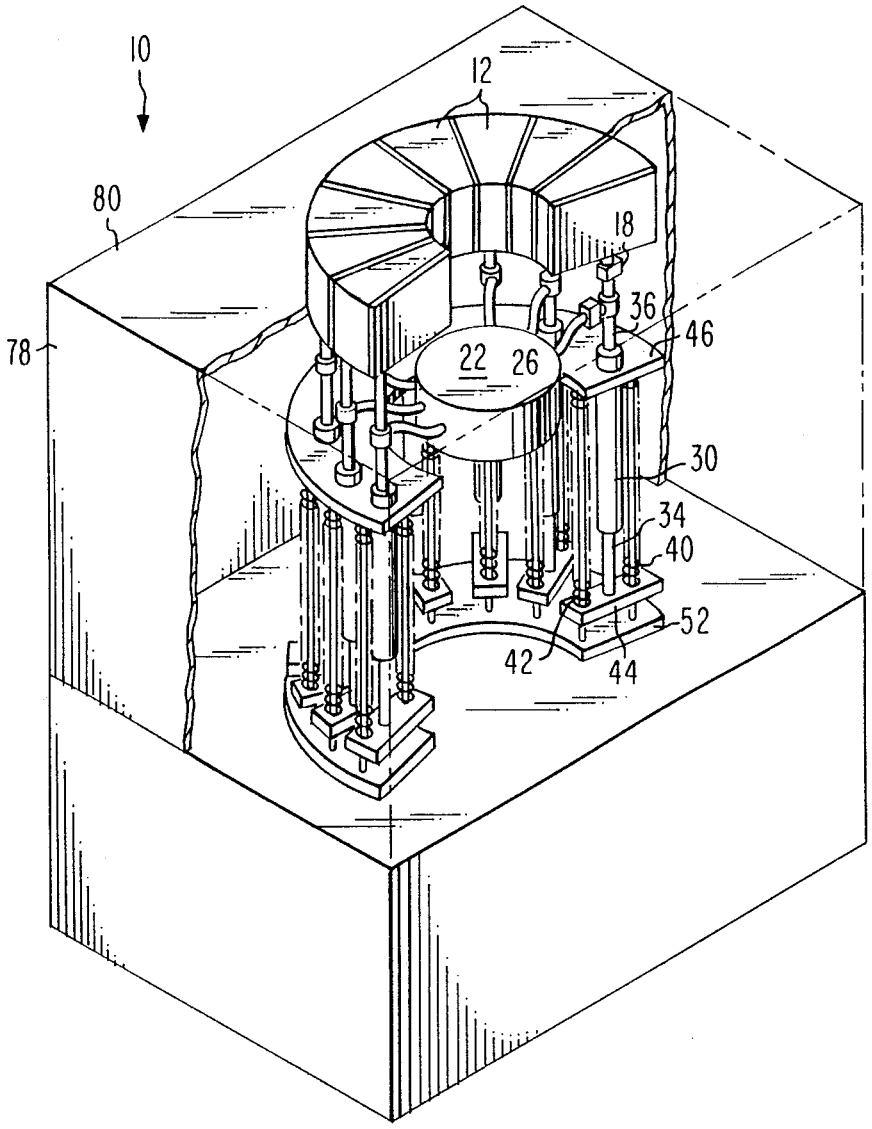
FIG. 3 is a perspective view of one form of the liquid dispenser of the present invention.

Referring to FIG. 3, there is shown a form of the liquid dispenser 10 of the present invention. The dispenser 10 includes a housing 78 with the reservoirs 12 mounted on the top 80 thereof. As shown, the reservoirs 12 are arranged in a semi-circle. Within the housing 78, the dispensing cylinders 30 are mounted vertically so as to be arranged in a semi-circle corresponding to the arrangement of the reservoirs 12. The dispensing cylinders 30 are positioned with the piston rods 34 projecting from the bottom of the cylinders 30 and the inlet/outlet pipes 36 being at the top of the cylinders 30. The springs 40 and 42 for each dispense cylinder 30 are arranged along the sides of the dispense cylinder 30. The inlet/-outlet pipe 36 of each dispense cylinder 30 is connected through a valve 18 to its respective reservoir 12 which is directly above it.

Figure 4:
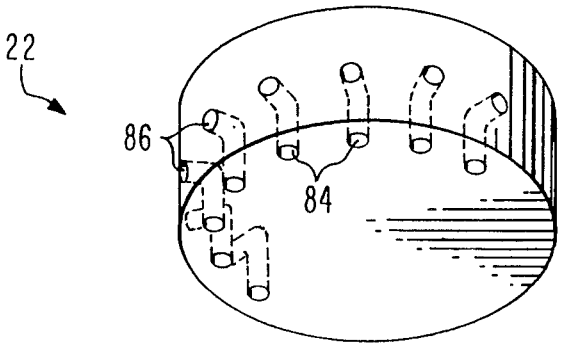
FIG. 4 is a perspective view of a nozzle array which can be used in the liquid dispenser shown in FIG. 3.

The inlet/outlet pipe 36 of each dispense cylinder 30 is also connected through a valve 26 to a nozzle 22 which is mounted in the housing 78 adjacent the top 80 and at the center of the semi-circle around which the dispense cylinders 30 are arranged. As shown in FIG. 4, the nozzle 22 is a circular block having a plurality of dispense openings 84 in its bottom surface and arranged around a semi-circle. A plurality of passages 86 extend radially through the nozzle from its outer periphery to the respective dispense openings. Each dispense cylinder 30 is connected to a separate one of the passages 86. Thus, the liquids from the reservoirs 12 can be dispensed through the respective dispense openings 84 into a container which is mounted beneath the nozzle 22. The mechanisms of the operating system 54 can be mounted in the housing 78 behind the dispense cylinders 30.

Figure 5:
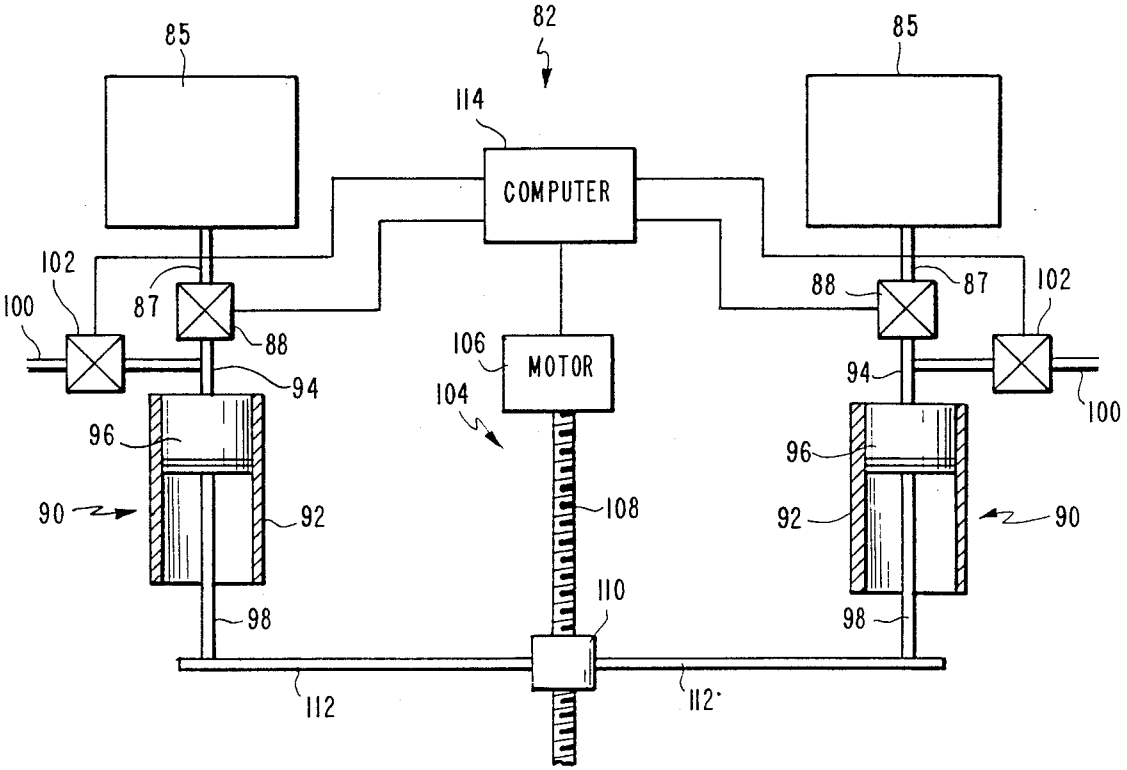
FIG. 5 is a schematic showing of a modification of the liquid dispenser of the present invention.

Referring to FIG. 5, a modification of the liquid dispenser of the present invention is generally designated as 82. Dispenser 82 includes a plurality of reservoirs 85, one of each color, each having an outlet pipe 87. An electrically operated valve 88 is in each of the outlet pipes 87. A separate hydraulic type operating system 90 is connected to each reservoir through its respective valve 88. Each hydraulic operating system 90 includes a cylinder 92 having an inlet pipe 94 extending from one end and connected to a respective one of the valves 88. A piston 96 is in the cylinder 92 and has a piston rod 98 extending therefrom through the other end of the cylinder 92. A dispensing pipe 100 is connected to each of the cylinder inlet pipes 94 and extends to a nozzle, such as the nozzle 22 shown in FIG. 4. An electrically operated valve 102 is in each of the dispensing pipes 100.

A control system 104 is connected to all of the hydraulic operating systems 90. The control system 104 includes a stepper or servo motor 106 having a threaded output shaft 108. A drive nut 110 is threaded on the shaft 108 and has drive arms 112 projecting therefrom. The drive arms 112 are connected to the piston rods 98 so that movement of the drive nut 110 along the shaft moves the pistons 96 in the cylinders 92. A computer 114 is electrically connected to the valves 88 and 102 and the motor 106 so as to control the operation of the valves and motor.

In general the operation of the dispenser 82, such as to dispense a particular color pigment into a can of white paint, the computer 114 is provided with information as to the particular color pigment desired and the amount of the pigment desired. The computer causes all of the valves 88 to be opened and all of the valves 102 to the nozzle to be closed. The stepper motor 106 is rotated to move the drive nut 110 in the direction which moves all of the pistons 96 away from the cylinder inlet pipes 94 and thereby draw liquid from the reservoirs 85 into the cylinders 92. The drive nut 110 is moved a distance to draw into the cylinders 92 the desired amount of pigment. The computer 114 then opens the valve 102 to the nozzle for the particular color to be delivered and closes the reservoir valve 88 for that color. The motor 106 is then rotated in the opposite direction to move the pistons 96 against the liquids in their respective cylinders 92. This forces the desired color pigment to the nozzle where it is delivered to the paint to be colored. The pigments in the outer cylinders 92 are delivered back into their respective reservoirs 85.

Thus, there is provided by the present invention a liquid dispenser which is hydraulically operated. This minimizes the number of mechanical parts so as to achieve low manufacturing cost and high reliability. High dispense precision is achieved for dispensing a plurality of different fluids using only a single operating mechanism for all of the dispense systems. Also, the number of dispense systems can be simply varied to allow the construction of a dispenser which can dispense any number of desired different liquids. Since the operating parts are all electrically operated the dispenser is well suited for computer control.

In order to insure the accuracy and reproducibility of the liquid dispensing systems described herein as well as improving the operation of prior art systems it is important to insure that the pigment (or other suspended particulate matter, depending upon the liquid to be dispensed) remains thoroughly mixed, without settling, and that the system has little or no dead space and is capable of being purged and substatially eliminate bubbles. Settling and/or accumulation of pigment in various regions would adversely effect the accuracy and reproducibility of the amount of liquid and/or pigment within such liquid which is to be dispensed. Further, settling could lead to clogging of the nozzle.

By providing a stirring means of the type shown in FIGS. 6 and 7 in the paint reservoir 12, one can insure stirring of the liquid which will maintain substantially all of the pigment in suspension with a minimal dead space.

Generally, the novel stirrer, which is inserted into the liquid reservoir comprises vertically reciprocating means for causing the liquid in the reservoir to have an elongated eleptical flow pattern wherein the liquid is forced upwardly along the walls of the reservoir and then flows downwardly in the central portion of the reservoir. An example of such a stirrer is shown in FIGS. 6 and 7.

Referring to the figures there is shown in FIG. 6 a cross section of a reservoir 12 for paint or other particulate containing liquid 120. Centrally located and extending within the reservoir 12 is a reciprocating rod 122. Attached to the bottom of the rod 122 there is a cylindrical cup 124 having an opening 125 at the bottom thereof to allow liquid to flow therethrough. A resilient umbrella valve 126 consisting of one or more resilient flaps 128 which allows flow of fluid in only one direction through the cup 124 is secured to the rod 122 at its lower end 130. The flap may be secured by a simple nut 132 and washer 134 on the rod 122. A top view of the cup is shown in FIG. 7. The cylindrical cup fits within the reservoir such that a space which is sufficient to allow the free flow of liquid exists between the inner wall of the reservoir 12 and the outer wall of the cup 124. The optimum size of the space will depend upon such parameters as the viscosity of the liquid and the rate of reciprocation employed. Also, in order to minimize dead space, the bottom of the cup preferably conforms in shape to the bottom of the reservoir 12 so that substantially all of the liquid can be displaced by the reciprocating stirrer.

In operation, downward motion of the rod 122 forces the cup 124 to the bottom of the reservoir 12. During this motion the umbrella valve seats on the bottom of the cup 124 thereby preventing the flow of liquid 120 through the center of the cup and forcing the liquid 120 to flow upwardly along the sides of the reservoir 12 in the space between the reservoir and the cup 124. After reaching the bottom (or close thereto) of the reservoir 12 such that substantially all of the liquid 120 in the reservoir 12 is displaced, the rod 122 is lifted thereby lifting the cup 124 and releasing the seat formed between the umbrella valve 126 and the bottom of the cup 124. This allows substantially all of the liquid 120 to flow through the open portions at the bottom of the cup 124 thereby creating a stirring of the fluid in a manner so as to provide an elliptical flow as shown by the arrows in FIG. 6.

It should be understood that the stirrer design described above is merely illustrative of the novel stirrer. For example, while the bottom of the cup must be open to allow flow of fluid therethrough when the umbrella valve 126 is open, the bottom can be provided with a screen or lattice structure rather than the spoke-like structure shown in FIG. 7. Further, the stirrer need not be a cup shaped member but can merely be a plate or cylinder provided with openings to allow liquid flow therethrough when the umbrella valve 126 is open. In addition, other one way valves can be employed in place of the umbrella valve. Also one can provide a filter, e.g. a wire mesh across the openings or elsewhere on the cup to filter out unwanted particles.

Figure 8:
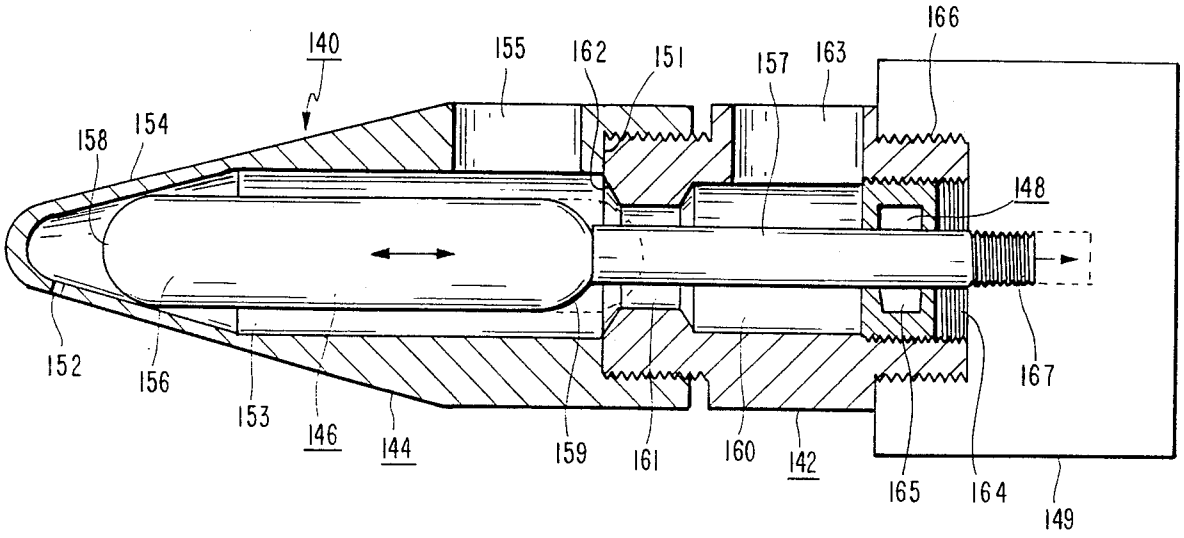
FIG. 8 is a cross-sectional view of a novel nozzle useful in a liquid dispenser system.
Figure 9:
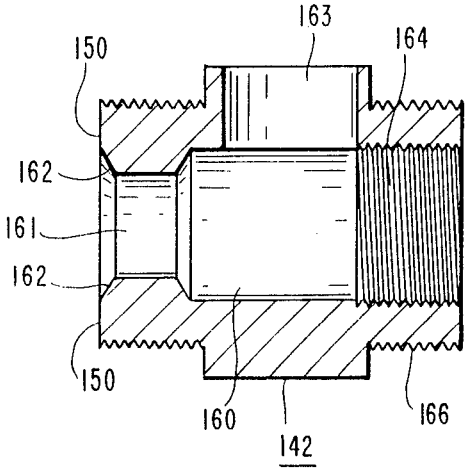
FIG. 9 is a cross-sectional view of the nozzle body section of the nozzle shown in FIG. 8.

A further improvement in accuracy and reproducibility of the liquid dispenser is attainable by use of the novel nozzle shown with reference to FIGS. 8 and 9. The nozzle is a key component of any high precision liquid dispensing system. To achieve the reproducibly high accuracy desired, e.g., $+10^{-3}$ oz. in certain pigment delivery systems, failure to suck-back and/or purge even the last drop of fluid after a dispense cycle can result in a large error in the subsequent dispense volume. Also, the presence of air bubbles must be avoided while maintaining a reasonably high cycle rate. Prior art nozzles have been found deficient in at least one of several ways. For example, they do not allow for purging of the liquid retained in the nozzle. This can lead to pigment settling and clogging of the lines. Further, they do not provide suck-back of substantially all of the liquid in the nozzle tip leading to inaccuracy and often they are plagued with the collection of air bubbles.

The novel nozzle design described herein substantially eliminates the above mentioned problems as it provides means for purging and suck-back with a minimal dead space. As can be seen with reference to FIGS. 8 and 9, the nozzle assembly 140 comprises a nozzle body 142; a nozzle cap 144 secured to the front of the nozzle body 142; a plunger 146 reciprocally mounted in the nozzle body 142 and nozzle cap 144; a plunger seal means 148 for preventing fluid in the nozzle from escaping from the rear of the nozzle assembly 140; and means 149 for activating the pluger.

The nozzle cap 144 is removably secured to the front portion of the nozzle body 142 such as by providing mating screw threads on the internal rear portion of the nozzle cap 144 and the external front portion of the nozzle body 142. The cap 144 must be secured to the nozzle body in a manner to prevent leakage of liquid at the area of mating of the two parts. Here, the body 142 and cap 144 have smooth mating faces 150 and 151 respectively, which prevent fluid leakage. If desired, one can provide a groove for an O-ring seal at this interface. The front portion of the cap 144 is provided with one or more exit holes 152 for dispensing the liquid to be delivered. The cap 144 is hollow so as to provide a cavity 153 in which the head of the plunger 146 can reciprocally move axially therein. The forward portion 154 of the cap 144 is tapered such that the exit hole 152 is sealed from the remainder of the nozzle when the plunger 146 is in its forward most (closed) position. The cap 144 is provided with a liquid inlet port 155 in front of the nozzle body mating means which communicates with the cavity 153.

The plunger 146, as shown, is a cylindrical member having a front half or head 156 that is wider than the rear half or shalf 157. The front 158 of the plunger head 156 is hemispherical and the back part 159 of the head 156 is arcuately tapered to the diameter of the plunger shaft 157. The plunger 146 is reciprocally mounted in the nozzle assembly 140 such that the head 156 of the plunger 146 rests within cavity 153 of the nozzle cap 144.

The nozzle body 142 has a central cavity 160 which communicates with the cavity 153 of the nozzle cap 144 when the plunger 146 is forward of its rearmost position. The front of the nozzle body has a hole 161 extending therethrough into the central cavity 160. The hole 161 is of a dimension which will prevent the head 156 of the plunger 146 from sliding therethrough. Further, the front face of the nozzle body is provided with a chamfer 162 around the hole 161 where the rear arcuate portion 159 of the plunger head 156 seats to prevent the flow of liquid from the cavity 153 of the cap into the central cavity 160 of the nozzle body when the plunger 146 is in its rearmost position. A liquid purge port 163 is provided in the nozzle body 142 which communicates with the central cavity 160 of the nozzle body. The rear portion of the nozzle body is provided with a threaded guide hole 164 in which the plunger collar seal 148 is threaded. The collar seal has a hole 165 through which the rear of the plunger shaft 157 extends. The rear of the nozzle body and plunger shaft are provided with means, such as screw threads 166 and 167 respectively, for attaching the nozzle assembly to plunger actuating means 149. The actuating means may be a simple electro-magnetic solenoid or may be hydraulic, pneumatic or mechanical actuating means as is known in the art.

In operation of the nozzle 140, when the nozzle 140 is closed i.e., when the plunger 146 is in its foreward-most position, liquid flows into the liquid inlet port 155 and then into the nozzle body 142 and out of the liquid outlet port 163 and back to the reservoir 12 thereby purging the system. When open, i.e., when the plunger 146 is in its most rearward position, liquid flows into the nozzle 140 through the inlet port 155 and out of the liquid dispense hole 152 thereby dispensing the liquid. The design of the nozzle is such that pressurization of the input chamber by liquid from the inlet port tends to seat the plunger more firmly in both the open and closed positions preventing unwanted leakage. Further, substantially all the liquid in the output channel may be sucked back after the dispense, thus maintaining the accuracy of the system. We have unexpectedly discovered that the novel nozzle design, upon closing after the dispense cycle ejects liquid which would otherwise tend to remain in the nozzle tip. This helps prevent clogging of the tip and droplets forming outside the nozzle dispense opening.

The basic preferred operation of the liquid dispense systems, such as the ones described with reference of FIG. 1 or FIG. 5 incorporates the following procedure starting with the respective operating piston in its fully unpressurized position:

1. Predispense motion: with the nozzle closed, the piston is moved enough to take up any backlash and to cause the checkvalve to the nozzle to open and the checkvalve to the reservoir to close and purge air out of the nozzle into the purge line.
2. A short predispense delay is allowed for the pressure in the dispense line to be stablize to system pressure.
3. The nozzle is opened and the piston moved up to dispense the required amount of liquid.
4. There is a short post-dispense delay to allow pressure build up in the lines to dissipate.
5. The nozzle is closed to eject the small quantity of the viscous liquid tending to remain in the tip of the nozzle and prevent drops of the liquid from sticking to the end of the nozzle.
6. The nozzle is then opened while the piston is returned to the start position. This sucks paint back into the nozzle, (along with some air) and purges the tip of the nozzle until the checkvalve to the nozzle seats and closes at which time suck-back stops and liquid enters the piston cylinder from the holding tank. The amount of the suck-back volume is essentially dependent upon the size of the check valve. The nozzle ils then closed and the sequence is then repeated.

When one or more nozzles have not been used for some time, we find that the first dispense may be slightly erroneous, and may tend to leave a liquid drop hanging from the nozzle. This can be avoided by a start of procedure consisting of a number of purge and suck-back cycles and the nozzle exercise cycles.

An alternate operating procedure that is less accurate but faster than the preferred procedure described above is to move the piston up at constant speed and open the dispense nozzle for a precisely measured time to control the volume dispensed.

What is claimed is:

1. A liquid dispensing system comprising (a) a reservoir for containing the liquid to be dispensed;
(b) means for stirring the liquid in the reservoir;
(c) a nozzle for dispensing the liquid connected to said reservoir;
(d) means for removing liquid from reservoir and feeding the liquid to the nozzle;
(e) means for purging liquid remaining in the nozzle, subsequent to dispensing some of the liquid;
(f) means for feeding a controlling amount of the liquid to the nozzle for dispensing; and
(g) means for causing liquid remaining in the nozzle tip subsequent to dispensing to be sucked-back.

2. The liquid dispensing system recited in claim 1 wherein said nozzle comprises a liquid inlet port for accepting liquid from the reservoir to be dispensed, a liquid dispensing port which communicates with said inlet port when the nozzle is in an open position for dispensing the liquid, a liquid purge port which communicates with said liquid inlet port when the nozzle is in a closed position for purging liquid remaining in the nozzle subsequent to dispensing the liquid, and nozzle activator means for opening and closing the nozzle so as to change the direction of liquid flow.

3. The liquid dispensing system recited in claim 2 wherein said nozzle comprises a nozzle cap having a liquid dispensing hole at its tip, a liquid feed port for feeding liquid into the nozzle, a cavity in said nozzle cap for accommodating a plunger, means for isolating said dispensing hole from said liquid feed port when said plunger is in its forwardmost position, a nozzle body member removably affixed to said nozzle cap and having a central cavity which communicates with the cavity of the nozzle cap via a throughhole in the front of the nozzle body, a liquid purge port in the nozzle body which communicates with the central cavity, said plunger being reciprocally movable within said cavities and having a cylindrical head portion contained within said nozzle cap cavity and a narrow shaft portion which extends axially through said nozzle body; and said nozzle activator means actuating said plunger.

4. The liquid dispensing system recited in claim 3 wherein said plunger, when in a first or closed position, forms a seal within said nozzle cap proventing liquid from being dispensed through the liquid dispense port while allowing liquid to flow from the inlet port to the liquid purge port, and when in a second or open position, forms a seal between the communicating cavities allowing liquid to be dispensed from the nozzle and stopping the flow of liquid to the purge port and wherein the suck-back means are coupled to the nozzle to cause suck-back after dispensing said liquid but prior to closing said nozzle for purging of said system.

5. The liquid dispensing system recited in claim 2 including a first one-way valve between said reservoir and said liquid inlet port and a second one-way valve between said reservoir and said liquid purge port, said first valve allowing flow in a direction from the reservoir to the nozzle, said second valve allowing flow from the nozzle to the reservoir.

6. The liquid dispensing system recited in claim 2 wherein the nozzle is actuated by a solenoid and said means for feeding a controlled amount of the liquid to the nozzle, sucking-back the liquid in the nozzle tip and purging the liquid in the nozzle comprises a piston, the movement of which in an appropriate amount, direction and sequence accomplishes each function.

7. The liquid dispensing system recited in claim 6 including means for causing said piston to move to (a) first take-up any backlash and to purge air out of the nozzle followed by a delay to allow the pressure in the dispense line to be reduced to atmospheric pressure; and then (b) to dispense the required amount of liquid after the nozzle is open followed by a post-dispense delay to allow any pressure build-up to dissipate; and then (c) returned to its starting position to suck back paint at the nozzle tip.

8. The liquid dispensing system recited in claim 6 wherein said means comprises a computer control.

9. The liquid dispensing system recited in claim 1 wherein the means for stirring the liquid in the reservoir comprises a vertically reciprocating stirrer which causes a vertical elliptical flow pattern of the liquid wherein the liquid is forced upwardly along the walls of the reservoir and then downwardly in the central portion of the reservoir.

10. The liquid dispensing system recited in claim 9 wherein the stirrer comprises an elongated reciprocating vertical rod having means attached thereto for forcing liquid downwardly in the central region of the reservoir and upwardly along the sides of the reservoir during the downward movement of the rod said means comprising a cylindrical member having openings through its central portion to allow the flow of liquid therethrough, a one way valve member which closes upon downward movement of the rod preventing the flow of liquid through said openings and means for securing said cylindrical member and valve member to said rod.

11. The liqiud dispensing system recited in claim 9 wherein the stirrer comprises a cup shaped member having an opening at its bottom, a resilient one-way umbrella valve at the base of the cup shaped member and an elongated vertical rod to which the cup shaped member is secured, said cup shaped member having a diameter sufficiently smaller then the inner diameter of the reservoir to allow the elliptical flow of liquid in said reservoir.

12. The liquid dispensing system recited in claim 3 wherein the means for stirring the liquid in the reservoir comprises a vertically reciprocating stirrer which causes a vertical elliptical flow pattern wherein the liquid is forced upwardly along the walls of the reservoir and then downwardly in the central portion of the reservoir.

13. The liquid dispensing system recited in claim 12 wherein the stirrer comprises an elongated reciprocating vertical rod having means attached thereto for forcing liquid downwardly in the central region of the reservoir and upwardly along the side of the reservoir during the downward movement of the rod said means comprising a cylindrical member having openings through its central portion to allow the flow of liquid therethrough, a one way valve member which closes upon downward movement of the rod preventing the flow of liquid through said openings and means for securing said cylindrical member and valve member to said rod.

14. The liquid dispensing system recited in claim 12 wherein the stirrer comprises a cup shaped member having an opening at its bottom, a resilient one-way umbrella valve at the base of the cup shaped member and an elongated vertical rod to which the cup shaped member is secured, said cup shaped member having a diameter sufficiently smaller then the inner diameter of the reservoir to allow the elliptical flow of liquid in said reservoir.

15. A stirrer for stirring liquid contained in a reservoir comprising a vertically reciprocating stirrer which causes a vertical elliptical flow pattern wherein substantially all of the liquid is forced upwardly along the walls of the reservoir and then downwardly in the central portion of the reservoir.

16. The stirrer as recited in claim 15 wherein the stirrer comprises an elongated reciprocating vertical rod having means attached thereto for forcing liquid downwardly in the central region of the reservoir and upwardly along the sides of the reservoir during the downward movement of the rod said means comprising a cylindrical member having openings through its central portion to allow the flow of liquid therethrough, a one way valve member which closes upon downward movement of the rod preventing the flow of liquid through said openings and means for securing said cylindrical member and valve member to said rod.

17. The stirrer as recited in claim 15 wherein the stirrer comprises a cup shaped member having an opening at its bottom, a resilient one-way umbrella valve at the base of the cup shaped member and an elongated vertical rod to which the cup shaped member is secured, said cup shaped member having a diameter sufficiently smaller then the inner diameter of the reservoir to allow the elliptical flow of liquid in said reservoir.

18. A method for dispensing liquid in a liquid dispensing system comprising a reservoir, a stirrer, a nozzle and piston means for conveying liquid from the reservoir to the nozzle, purging the system and sucking-back liquid at the nozzle tip comprising the steps of (a) moving said piston to take up any backlash and to purge air out of the nozzle followed by a delay to allow the pressure in the dispense line to be reduced to atmospheric pressure; (b) dispensing the required amount of liquid after the nozzle is open followed by a post-dispense delay to allow any pressure build-up to dissipate; and (c) returning the piston to its starting position to suck-back liquid at the nozzle tip.

* * * * *